US010043623B2

(12) United States Patent
Boettcher et al.

(10) Patent No.: US 10,043,623 B2
(45) Date of Patent: Aug. 7, 2018

(54) DEVICE FOR TRANSMISSION OF FORCES

(71) Applicant: Siemens Aktiengesellschaft, München (DE)

(72) Inventors: Martin Boettcher, Berlin (DE); Karsten Freundt, Falkensee (DE); Ludvik Godesa, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 88 days.

(21) Appl. No.: 14/907,916

(22) PCT Filed: Jul. 31, 2014

(86) PCT No.: PCT/EP2014/066454
§ 371 (c)(1),
(2) Date: Jan. 27, 2016

(87) PCT Pub. No.: WO2015/022194
PCT Pub. Date: Feb. 19, 2015

(65) Prior Publication Data

US 2016/0181037 A1 Jun. 23, 2016

(30) Foreign Application Priority Data

Aug. 13, 2013 (DE) ..... 10 2013 216 018

(51) Int. Cl.
*H01H 33/66* (2006.01)
*H01H 50/02* (2006.01)
(Continued)

(52) U.S. Cl.
CPC ..... *H01H 50/02* (2013.01); *H01H 1/54* (2013.01); *H01H 50/56* (2013.01); *H01H 51/30* (2013.01);
(Continued)

(58) Field of Classification Search
CPC ..... H01H 1/5822; H01H 1/54
(Continued)

(56) References Cited

U.S. PATENT DOCUMENTS 1,672,365 A * 6/1928 Burnham ..... H01H 33/025 218/91
3,614,353 A * 10/1971 Yoshio ..... H01H 1/54 200/304
(Continued)

FOREIGN PATENT DOCUMENTS

CN 2356418 Y 12/1999
CN 1787147 A 6/2006
(Continued)

OTHER PUBLICATIONS

International Search Report PCT/ISA/210 for International Application No. PCT/EP2014/066454 dated Sep. 25, 2014.
(Continued)

*Primary Examiner* — Alexander Talpalatski
(74) *Attorney, Agent, or Firm* — Harness, Dickey & Pierce, P.L.C.

(57) ABSTRACT

A device is disclosed for transmission of forces on a moving contact connecting bolt of a contact system including a switching unit with a moving contact and a further contact. The device includes an at least partially flexible conductor element for electrical connection of the moving contact connecting bolt to a connection of the switching unit and at least one first branch and a second branch. The branches are arranged for reciprocal current flow to generate an electromagnetic force. The invention the second branch is guided along and retained on a support plate firmly connected to the moving contact connecting bolt such that an electromagnetic force occurring in a short-circuit is introduceable between the first branch and the second branch for increasing a contact pressure exerted by a contact pressure spring in the
(Continued)

moving contact connecting bolt, the support plate being slidably movable in the housing of the switching unit.

8 Claims, 2 Drawing Sheets

(51) Int. Cl.

| | |
|---|---|
| ***H01H 1/54*** | (2006.01) |
| ***H01H 77/10*** | (2006.01) |
| ***H01H 50/56*** | (2006.01) |
| ***H01H 51/30*** | (2006.01) |
| *H01H 33/02* | (2006.01) |
| *H01H 33/664* | (2006.01) |
| *H01H 33/666* | (2006.01) |

(52) U.S. Cl.
CPC ..... *H01H 77/101* (2013.01); *H01H 33/022* (2013.01); *H01H 33/6606* (2013.01); *H01H 2033/6648* (2013.01); *H01H 2033/6665* (2013.01); *H01H 2235/01* (2013.01)

(58) Field of Classification Search
USPC ..... 335/16, 147, 195
See application file for complete search history.

(56) References Cited

U.S. PATENT DOCUMENTS

| | | | | | |
|---|---|---|---|---|---|
| 3,665,350 | A * | 5/1972 | Klint | H01H 1/54 | 335/195 |
| 4,032,870 | A * | 6/1977 | Oppel | H01H 1/54 | 335/147 |
| 4,153,827 | A * | 5/1979 | Mircovich | H01H 33/12 | 218/26 |
| 4,247,745 | A * | 1/1981 | Wilson | H01H 33/666 | 200/DIG. 42 |
| 5,486,662 | A * | 1/1996 | Takiishi | H01H 1/5822 | 200/50.27 |
| 5,521,348 | A * | 5/1996 | Berndt | H01H 33/666 | 218/119 |
| 5,528,009 | A * | 6/1996 | Marquardt | H01H 33/666 | 218/121 |
| 6,140,894 | A * | 10/2000 | Lane | H01H 77/101 | 218/22 |
| 6,410,874 | B2 * | 6/2002 | Marin-Pache | H01H 33/666 | 218/118 |
| 2002/0179571 | A1 * | 12/2002 | Rhein | H01H 33/6662 | 218/7 |

FOREIGN PATENT DOCUMENTS

| | | | |
|---|---|---|---|
| DE | 69701227 | | 1/1998 |
| DE | 102008049789 | A1 | 4/2009 |
| JP | S5355781 | A | 5/1978 |
| JP | H02215021 | A | 8/1990 |
| WO | WO-9320571 | A1 | 10/1993 |
| WO | WO-0109912 | A2 | 2/2001 |

OTHER PUBLICATIONS

Written Opinion of the International Searching Authority PCT/ISA/237 for International Application No. PCT/EP2014/066454 dated Sep. 25, 2014.
Chinese Office Action dated Jan. 23, 2017.
Korean Office Action and English translation thereof dated Jun. 5, 2017.

* cited by examiner

DEVICE FOR TRANSMISSION OF FORCES

PRIORITY STATEMENT

This application is the national phase under 35 U.S.C. § 371 of PCT International Application No. PCT/EP2014/066454 which has an International filing date of Jul. 31, 2014, which designated the United States of America and which claims priority to German patent application number DE 102013216018.6 filed Aug. 13, 2013, the entire contents of which are hereby incorporated herein by reference.

FIELD

An embodiment of the invention generally relates to an apparatus for transmitting forces on a moving contact connection pin of a contact system comprising a moving contact and a further contact of a switching device, having an at least partially flexible conducting element which is provided for electrically connecting the moving contact connection pin to a connection of the switching device and has at least one first limb and one second limb which are arranged for reciprocal current flow in order to thereby generate an electromagnetic force, wherein the first limb is arranged in a stationary manner in a housing of the switching device.

BACKGROUND

An apparatus for transmitting forces is known from the prior application DE 10 2012 216 974 made by the same applicant. The apparatus for transmitting forces disclosed in that document has an arrangement comprising an at least partially flexible conducting element having a first limb and a second limb which are arranged for reciprocal current flow in order to thereby generate an electromagnetic force, and comprises a latchable lever arrangement by which the electromagnetic force can be used firstly to increase the contact pressure force when the contact system is closed and secondly to assist the opening process of the contact system during a switch-off process.

SUMMARY

An embodiment of the present invention is directed to developing an apparatus of the kind mentioned in the introductory part which has a simple design.

According to an embodiment of the invention, an apparatus is disclosed wherein the second limb is guided along and held on a supporting plate, which is fixedly connected to the moving contact connection pin, in such a way that an electromagnetic force which occurs in a short circuit can be introduced between the first limb and the second limb in order to increase a contact pressure force, which is exerted by a contact compression spring, in the moving contact connection pin, wherein the supporting plate is guided such that it can move in a sliding manner in the housing of the switching device.

BRIEF DESCRIPTION OF THE DRAWINGS

The invention will be explained in greater detail below on the basis of the drawing and an exemplary embodiment with reference to the appended figures, in which.

DETAILED DESCRIPTION OF THE EXAMPLE EMBODIMENTS

Figure 1:
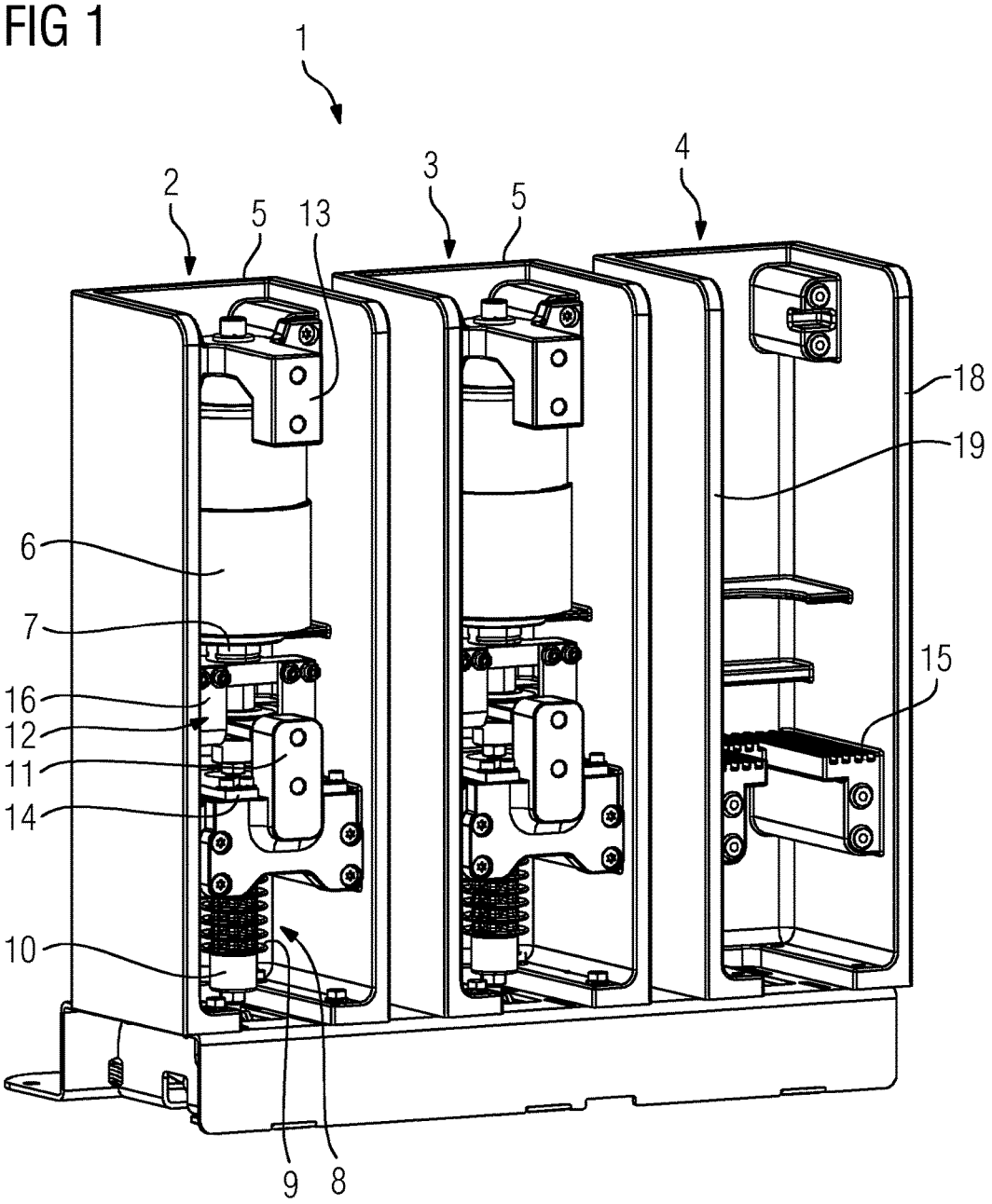
FIG. 1 shows a three-dimensional schematic view of an apparatus according to an embodiment of the invention in a switching device.

According to an embodiment of the invention, an apparatus is disclosed wherein the second limb is guided along and held on a supporting plate, which is fixedly connected to the moving contact connection pin, in such a way that an electromagnetic force which occurs in a short circuit can be introduced between the first limb and the second limb in order to increase a contact pressure force, which is exerted by a contact compression spring, in the moving contact connection pin, wherein the supporting plate is guided such that it can move in a sliding manner in the housing of the switching device.

Arranging the second limb in this way along a supporting plate which is connected to the moving contact connection pin in such a way that the electromagnetic force, which occurs in the event of a short circuit given a high short-circuit current, due to the reciprocal current flow through the first and the second limb is introduced into the moving contact connection pin via the supporting plate which is fixedly connected to the moving contact connection pin makes it possible for the contact pressure force, which is exerted onto the moving contact connection pin by the contact pressure spring, to be easily increased owing to this electromagnetic force, so that, in the event of a short circuit given a high short-circuit current, an opening request of the contact system is initially prevented for a certain period of time. This is necessary since the contact system of a switching device also has to be held closed for a controlled period of time in the event of a short circuit in order to be able to locate the short circuit in an energy distribution system.

In an advantageous development of an embodiment of the invention, the housing of the switching device has, on side walls, bearing surfaces for arranging the first limb in a stationary manner. Bearing surfaces of this kind in the housing of the switching device make it possible to easily mount the first limb in the housing in a stationary manner, so that the electromagnetic repulsion force which is produced between the first and the second limb can be effectively introduced into the moving contact connection pin via the supporting plate by arranging the first and the second limb for reciprocal current flow.

In a particularly advantageous refinement of an embodiment of the invention, the housing of the switching device has an internal dimension between its side walls which is slightly larger than an external dimension of the supporting plate in such a way that the supporting plate is guided within the housing such that it can move in a sliding manner between the side walls of the housing. In a further advantageous refinement of the invention, the housing of the switching device has an internal dimension between a guide surface of a first connection and a further guide element of a rear housing wall which is slightly larger than an external dimension of the supporting plate in such a way that the supporting plate is guided within the housing such that it can move in a sliding manner between the guide surface and the further guide element of the housing.

Owing to internal dimensions of this kind between the side walls of the housing of the switching device or between a guide surface of a first connection and a further guide element of a rear housing wall, which internal dimensions are matched to the external dimension of the supporting plate, guidance of the supporting plate such that it can move in a sliding manner within the housing of the switching device is easily provided, so that the transverse forces which occur given a short-circuit current, in particular advantageously, do not lead to a deflection or transverse loading of the entire arrangement, but rather are absorbed by the housing of the switching device owing to the guidance of the supporting plate within the housing of the switching device, without transverse loadings, for example by moving contact connection pins or other moving parts, occurring.

FIG. 1 shows a switching device 1 in the form of a circuit breaker comprising a three-phase arrangement, as is used for energy distribution in the medium-voltage range for example. A pole 2, 3, 4, in each case with a housing 5, is provided for each phase of the switching device 1. In the illustration of a detail in FIG. 2, the housing 5 of the pole 2 of FIG. 1 is illustrated in a partially transparent manner for the sake of improved clarity, wherein the housing 5 is typically composed of an insulating material, for example epoxy resin or another plastic, in order to electrically insulate the poles 2, 3 and 4 from one another. Furthermore, only the pole 2 is described in greater detail in the text which follows. The poles 3 and 4 have the same design.

For the sake of clarity and for the purpose of improved description, only the pole housing of pole 4 is illustrated. Each of the poles 2, 3 and 4 comprises a vacuum interrupter 6 having a contact system, which is arranged in a vacuum-tight housing and is not shown in the figures, comprising a moving contact and a fixed contact for connecting and, respectively, interrupting a current which is carried via the switching device 1, wherein the switching device 1 is provided for disconnecting that part of the energy supply system which is connected to the switching device 1 in particular, for example, in the event of a short circuit after a predetermined time.

The moving contact of the contact system of the vacuum interrupter 6 is guided out of the vacuum interrupter 6 in a vacuum-tight manner via a moving contact connection pin 7 and is mechanically coupled via a drive rod 8 to a drive, which is likewise not illustrated in the figures, for initiating a drive movement for opening and, respectively, closing the contact system, wherein a contact compression spring, which is not illustrated in the figures, exerts a contact pressure force onto the moving contact of the vacuum interrupter via the drive rod in the closed state. The drive rod 8 has an insulating element 10, which is provided with ribs 9, for electrically decoupling the drive and the moving contact connection pin. The moving contact connection pin 7 is electrically conductively connected to a first connection 11 of the switching device 1 via a flexible conductor element 12, and the fixed contact of the contact system of the vacuum interrupter 6 is electrically conductively connected to a second connection 13 of the switching device 1 via a fixed contact connection pin, wherein the first connection 11 and the second connection 13 are provided for electrically conductive connection, for example, to a switching system or to an energy distribution network.

The flexible conductor element 12 comprises a first limb 14 which is arranged in the housing 5 in a stationary manner and bears on bearing surfaces 15 of the pole housing 5 in the housing, the bearing surfaces being shown more clearly in the housing of the pole 4. A second limb 16 of the flexible conductor element 12 is electrically conductively connected to the moving contact connection pin 7 and is guided along and held on a supporting plate which is fixedly connected to the moving contact connection pin 7.

In this case, the first limb 14 and the second limb 16 are arranged in such a way that a current which is carried via the switching device 1 flows through the first limb 14 and the second limb 16 in opposite directions, so that an electromagnetic repelling force is generated between the first limb 14 and the second limb 16. In this case, the second limb 16 is guided along and held beneath the supporting plate 17, so that an electromagnetic repulsion force of this kind between the first limb 14 and the second limb 16, owing to the stationary arrangement of the first limb 14 on the bearing surfaces 15 of the housing 5, acts on the supporting plate via the second limb 16 and therefore pushes the moving contact connection pin 7 upward in the exemplary embodiment and exerts a contact pressure force onto the contact system comprising the moving contact and the fixed contact of the vacuum interrupter 6, the contact pressure force assisting or increasing the contact pressure force of the contact compression spring 9 in the closed state of the contact system.

In this case, the housings 5 of the poles 2, 3 and 4 of the switching device 1 have an internal dimension between side walls 18 and 19 which is slightly larger than an external dimension of the supporting plate 17 in such a way that the supporting plate 17 is guided within the housing 5 such that it can move in a sliding manner between the side walls 18 and 19 of the housing 5 of the poles 2, 3 and 4, so that transverse forces which occur are absorbed by the housing 5 given a short-circuit current in order, in particular, to not be able to lead to a deflection of moving parts, such as the moving contact connection pin or the flexible conductor elements for example. Furthermore, in addition to the lateral guidance, the supporting plate is also guided on the rear housing wall of the housing 5 and at the front on a guide element which is provided on the first connection 11, as explained in greater detail further below with reference to FIG. 2.

Figure 2:
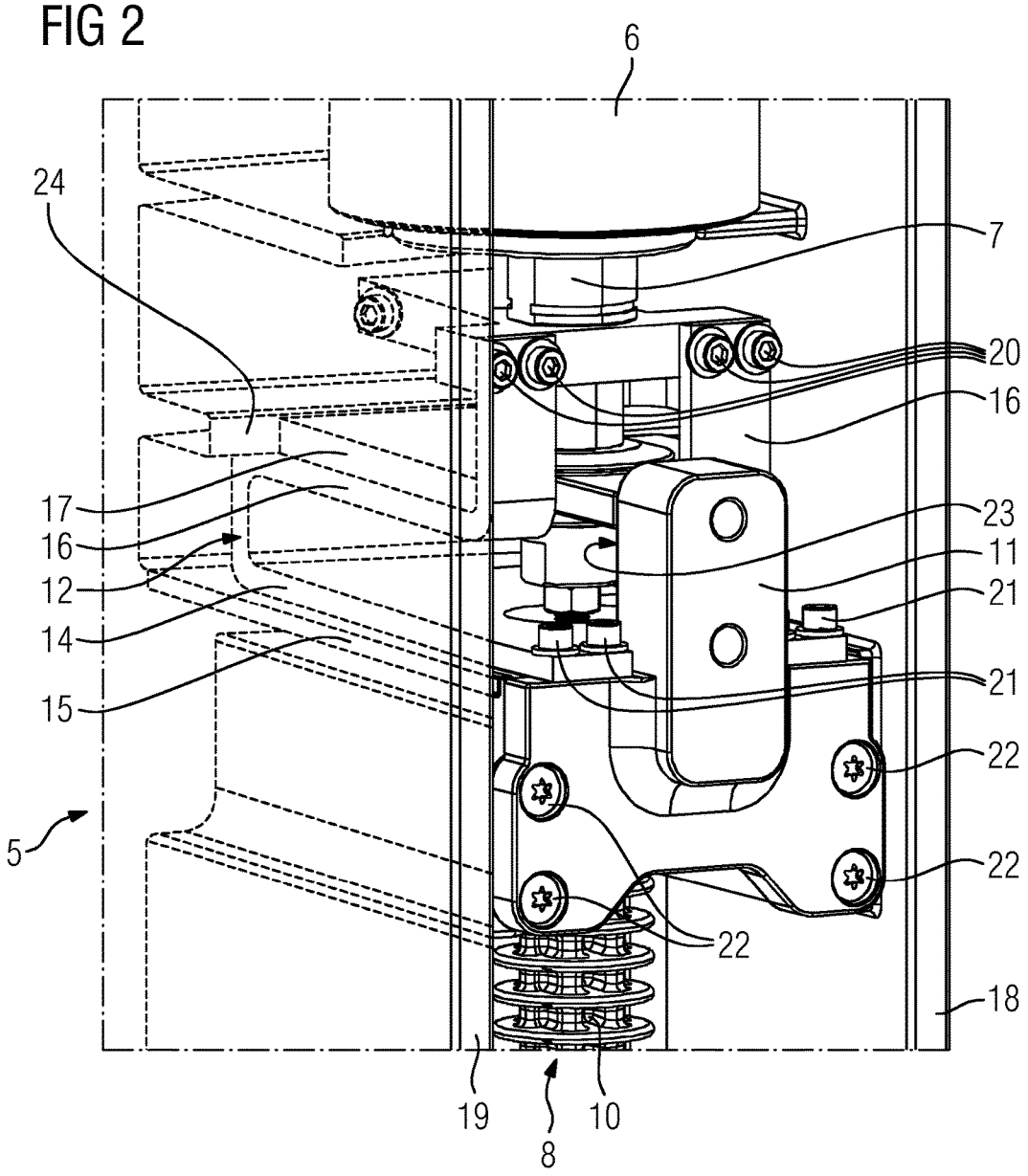
FIG. 2 shows a view of a detail of the example embodiment of FIG. 1.

FIG. 2 shows a view of a detail of the pole 2 from FIG. 1 with the vacuum interrupter 6 and the moving contact connection pin 7 which is electrically conductively connected to the first connection 11 via the flexible conductor element 12. The second limb 16 of the flexible conductor element 12, which second limb is held beneath the supporting plate 17 such that it is guided along the supporting plate in the exemplary embodiment, is connected to the moving contact connection pin 7 via fastening elements 20, and the first limb 14 is electrically conductively connected to the first connection 11 via fastening elements 21. The first limb 14 bears on the bearing surfaces 15 of the housing 5 of the switching device 1 and is therefore arranged in the housing 5 in a stationary manner.

The insulator 10 of the drive rod 8 is likewise shown, as are fastening elements 22 for fastening the first connection 11 to the housing 5. Furthermore, the first connection 11 has a guide surface 23 on its side which faces the supporting plate 17, which guide surface 23, together with a further guide element 24 which is provided on the rear housing wall of the housing 5, provides guidance of the supporting plate 17 by the distance between the guide surface 23 and the further guide element being slightly larger than the dimension of the supporting plate 17 in such a way that guidance such that the supporting plate can move in a sliding manner is likewise made possible here, the guidance, analogously to the guidance by the side walls 18 and 19, ensuring forces are absorbed and a deflection of moving parts owing to forces of this kind is effectively suppressed.

Arranging the first limb 14 and the second limb 16 for reciprocal current flow generates a repelling electromagnetic force between the first limb 14 and the second limb 16 owing to the reciprocal current flow, the repelling electromagnetic force increasing the contact pressure force of the contact compression spring and, in particular given a short-circuit current which occurs, leading to a considerable increase in the contact pressure force, so that, given a short-circuit current, the contact system can be kept closed for a controlled period of time until a short circuit in the energy distribution network is located and then the contact system of the vacuum interrupter 6 can subsequently be opened in order to make it possible to disconnect that part which is connected to the energy distribution network via the switching device 1.

An embodiment of this kind of an apparatus for transmitting forces onto the moving contact connection pin 7 makes it easily possible to use drives which require a cost-effective and simple design and, in particular, comparatively low spring forces of the contact compression spring because, owing to the electromagnetic force, the force of the contact compression spring onto the closed contact system is increased, so that, in an arrangement of this kind, higher short-circuit currents can be handled given a comparatively low drive power and contact compression spring force.

LIST OF REFERENCE SYMBOLS

1 Switching device
2, 3, 4 Poles
5 Housing
6 Vacuum interrupter
7 Moving contact connection pin
8 Drive rod
9 Contact compression spring
10 Insulator
11 First connection
12 Flexible conductor element
13 Second connection
14 First limb
15 Bearing surface
16 Second limb
17 Supporting plate
18, 19 Side walls
20, 21, 22 Fastening elements
23 Guide surface
24 Further guide element

The invention claimed is:

1. An apparatus for introducing an electromagnetic force onto a moving contact connection pin of a contact system including a switching device, the switching device including a moving contact and a further contact, the apparatus comprising:

an at least partially flexible conductor element, to electrically connect the moving contact connection pin to a connection of the switching device; and at least one first limb and a second limb, arranged for reciprocal current flow, the at least one first limb being arranged in a stationary manner in a housing of the switching device and including two portions fixed to the housing on either side of a connection piece positioned between the two portions to electrically connect the at least one first limb to an external system through the connection piece, and the second limb being guidable along a movable supporting plate, movable laterally in a sliding manner in the housing of the switching device between side walls of the housing and guided by at least a guide surface of the connection piece, the moving contact connection pin being fixedly connected to the movable supporting plate such that, upon a short circuit condition occurring, an electromagnetic force between the at least one first limb and the second limb relatively increases a contact pressure force, exerted onto the moving contact connection pin, of a contact compression spring of the switching device, the housing of the switching device including bearing surfaces, on side walls of the housing, to arrange the at least one first limb in a stationary manner an internal dimension, between the side walls, slightly larger than an external dimension of the supporting plate such that the supporting plate is movable within the housing in a sliding manner between the side walls of the housing, and another internal dimension, between the guide surface of the connection piece and a further guide element of a rear housing wall of the housing, being slightly larger than an external dimension of the supporting plate such that the supporting plate is also movable within the housing in a sliding manner between the guide surface and the further guide element of the housing.

2. The apparatus of claim 1, wherein the switching device is a circuit breaker.

3. The apparatus of claim 2, wherein the switching device is a circuit breaker including a three-phase arrangement.

4. A switching device, comprising:

a moving contact;

a further contact; and the apparatus of claim 1.

5. The switching device of claim 4, wherein the switching device is a circuit breaker.

6. The switching device of claim 4, wherein the switching device is a circuit breaker including a three-phase arrangement.

7. A circuit breaker including a three-phase switching device, each of three phases of the three-phase switching device comprising:

a moving contact;

a further contact; and the apparatus of claim 1.

8. A method for a contact system including a switching device, the switching device including a moving contact and a further contact, the method comprising:

electrically connecting a moving contact connection pin to a connection of the switching device, at least one first limb and a second limb being arranged in the switching device for reciprocal current flow, the at least one first limb being arranged in a stationary manner in a housing of the switching device and including two portions fixed to the housing on either side of a connection piece positioned between the two portions to electrically connect the at least one first limb to an external system through the connection piece, and the second limb being guidable along a movable supporting plate, the moving contact connection pin being fixedly connected to the supporting plate and the supporting plate being movable laterally in a sliding manner in the housing of the switching device between side walls of the housing and guided by at least a guide surface of the connection piece, the housing of the switching device including bearing surfaces, on side walls of the housing, to arrange the at least one first limb in a stationary manner; an internal dimension, between the side walls, slightly larger than an external dimension of the supporting plate such that the supporting plate is movable within the housing in a sliding manner between the side walls of the housing; and another internal dimension, between the guide surface of the connection piece and a further guide element of a rear housing wall of the housing, being slightly larger than an external dimension of the supporting plate such that the supporting plate is also movable within the housing in a sliding manner between the guide surface and the further guide element of the housing; and introducing, upon a short circuit condition occurring, an electromagnetic force between the at least one first limb and the second limb to relatively increase a contact pressure force, exerted onto the moving contact connection pin by a contact compression spring of the switching device.

* * * * *